United States Patent [19]

Johnson

[11] 3,945,172

[45] Mar. 23, 1976

[54] VACUUM PACKAGING SYSTEM

[76] Inventor: Harold W. Johnson, 2751 Wagon Wheel Road, No. 34, Oxnard, Calif. 93030

[22] Filed: Feb. 14, 1975

[21] Appl. No.: 549,989

[52] U.S. Cl. ..... 53/112 A
[51] Int. Cl.[2] ..... B65B 31/02
[58] Field of Search ..... 53/22 A, 112 A

[56] References Cited

UNITED STATES PATENTS

| | | | |
|---|---|---|---|
| 3,216,832 | 11/1965 | King | 53/112 A X |
| 3,830,365 | 8/1974 | Krueger et al. | 53/22 A X |

*Primary Examiner*—Travis S. McGehee
*Attorney, Agent, or Firm*—Ralph B. Pastoriza

[57] ABSTRACT

A product is vacuum sealed between bottom and top sheets of plastic film by pre-forming the bottom sheet with a series of transverse, parallel channels and then heating and lowering the top sheet over the bottom sheet to sandwich the product therebetween. The bottom sheet has a width less than the top sheet so that a communication means to the exterior is provided with the respective channels. With this arrangement, a vacuum can be drawn from the channels and thus evacuate the air between the plastic sheets to effect the desired vacuum sealing.

12 Claims, 9 Drawing Figures

VACUUM PACKAGING SYSTEM

This invention relates to vacuum packaging systems and more particularly to an improved method and apparatus for the vacuum packaging of various products such as foods between bottom and top sheets of plastic film.

BACKGROUND OF THE INVENTION

Vacuum packaging of various products between bottom and top sheets of plastic film is well known in the art. One of the latest systems is disclosed in U.S. Pat. No. 3,828,520 issued to Merritt. This patent itself includes an excellent discussion of prior art developments in this particular field.

The Merritt patent constitutes an improvement over the discussed prior art therein in the provision of protuberances on a platen which will serve to provide for airway passages in the withdrawal of air between bottom and top plastic sheets utilized to sandwich a product therebetween and effect a desired sealing.

BRIEF DESCRIPTION OF THE PRESENT INVENTION

The present invention has to do with a vacuum packaging system similar to that shown and described in the above referredto Merritt patent but utilizing a modified method in that the bottom plastic sheet of film is effectively preformed to provide transversely extending channels, these channels serving as air passages to assure complete exhaustion of air from between the bottom and top sheets.

In a preferred apparatus, a platen member itself is provided with transverse channels formed in its top surface running from points spaced inwardly on one longitudinal edge across the platen to terminate in a longitudinal trough parallel and adjacent to the opposite longitudinal edge. The platen itself includes an interior plenum chamber communicating with the floor of the channels through small holes and also communicating with the trough.

With the foregoing arrangement and with the provision of a suitable vacuum drawing means connected to the plenum chamber, a bottom plastic sheet of film can be positioned on the platen and the initial withdrawing of air from the plenum chamber results in the bottom sheet having its portions overlying the platen channels drawn into the channels and thus preformed. The top plastic sheet is then lowered over the bottom sheet after positioning of a product to be sealed on the bottom sheet. The width of the bottom sheet itself is less than the width of the top sheet such that the trough is in communication with the space between the sheets so that air can be withdrawn from between the sheets in effecting the evacuating and sealing process.

With the foregoing arrangement, a high degree of evacuation of all air between the sheets when effecting a sealing operation can take place resulting in a greatly improved vacuum sealed packaging.

BRIEF DESCRIPTION OF THE DRAWINGS

A better understanding of the method and a preferred apparatus for carrying out the method of this invention will be had by referring to the accompanying drawings in which.

DETAILED DESCRIPTION OF THE INVENTION

Figure 1:
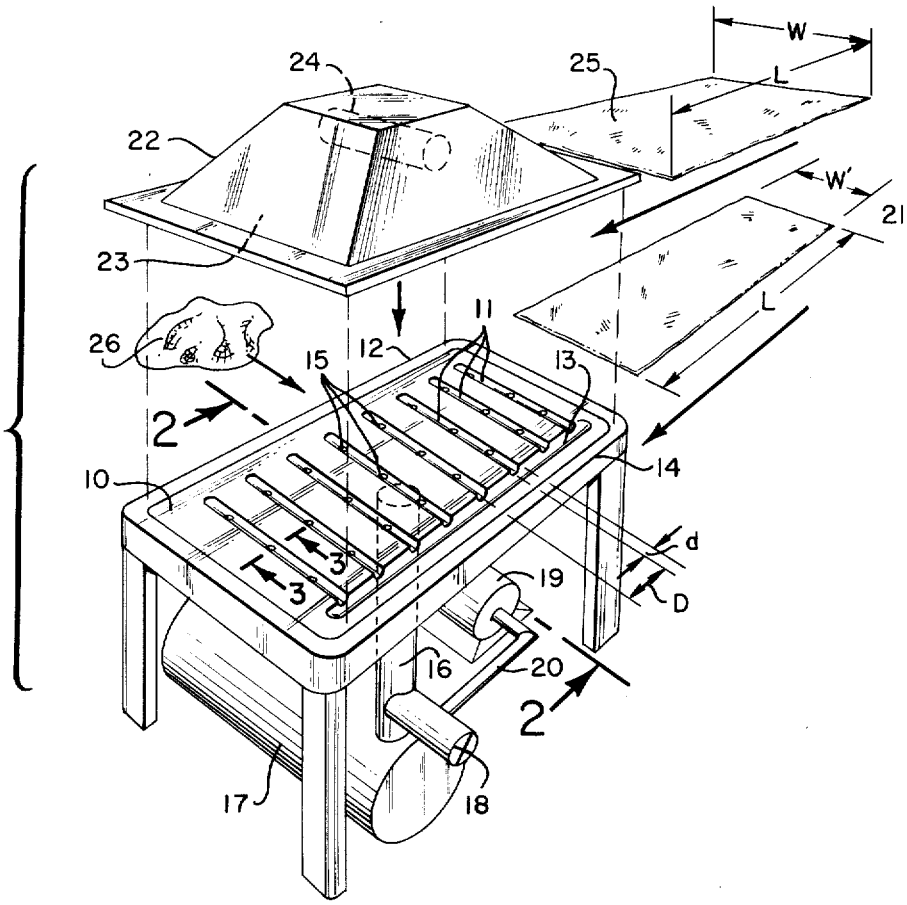
FIG. 1 is an exploded perspective view of a preferred apparatus for vacuum packaging of products in accord with the present invention.

Referring first to FIG. 1 there is shown a platen 10 having a plurality of transverse parallel channels 11 formed in its top surface running from points spaced inwardly from one longitudinal edge 12 across the platen to terminate in a longitudinal trough 13 parallel and adjacent to the opposite longitudinal edge 14.

Each of the channels 11 has a width *d* less than the spacing between the channels shown at D so that the channels take up a relatively small proportion of the overall top surface area of the platen 10. Further there are provided holes 15 in the floor of each of the channels. These holes as well as the trough 13 communicate with a plenum air chamber beneath the top surface of the platen 10.

A vacuum drawing means is disposed beneath the platen 10 and includes a conduit 16 connecting to the plenum chamber beneath the platen surface and an air tank 17. A valve 18 is connected in the conduit 16 between the tank 17 and plenum chamber. A vacuum pump 19 connects to the tank 17 by way of pipe 20 to maintain the tank 17 in an evacuated condition.

With the foregoing arrangement opening of the valve 18 will immediately evacuate the plenum chamber as a consequence of the same being placed in communication with the evacuated tank 17.

Referring now to the upper right hand portion of FIG. 1, there is shown a bottom sheet of plastic film 21 arranged to be positioned on the top surface of the platen 10. As indicated, sheet 21 has a length L and a given width W′ such that a longitudinal edge of the sheet does not extend over the trough 13 when the same is positioned on the platen surface.

Shown exploded above the platen surface 10 is a movable housing 22 having an open bottom 23 positioned to be brought down on top of the platen. This housing means 22 incorporates a heating means schematically indicated at 24. A top sheet of plastic film shown at 25 is arranged to be received under this housing above the bottom sheet. The top sheet 25 has a length L and a width W which is greater than the width W′ of the bottom sheet so that the longitudinal edge of the top sheet will overlap the trough 13 when the top sheet is brought down on top of the bottom sheet in carrying out the sealing operation of a food product such as indicated in exploded position at 26.

Figure 2:
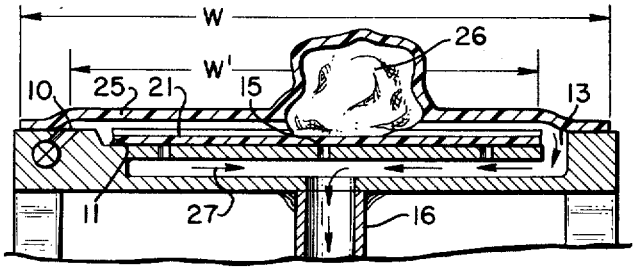
FIG. 2 is a fragmentary cross section taken in the direction of the arrows 2—2 of FIG. 1.

Referring to the cross section of FIG. 2, the plenum chamber beneath the surface of the platen 10 is clearly shown at 27 communicating with the conduit 16 from the air tank. Also, there is shown a communication between the plenum chamber 27 and the trough 13.

In FIG. 2 there is illustrated the specific evacuation and sealing operation of the product in accord with the present invention. It will be noted that the bottom sheet 21 has had portions overlying the channels 11 drawn into the channels as a consequence of initial evacuation when air is withdrawn from the plenum chamber 27. Thus, when the bottom sheet 21 is initially placed over the platen and the product 26 positioned on the bottom sheet, the initial drawing of air from the plenum chamber will preform the bottom sheet to provide therein channels as a result of the small holes 15 from which air is drawn. The lowering of the housing 22 together with the top sheet and the heating of the top sheet by the heating means results in a draping of the top sheet over the product 26 and thence over the bottom sheet 21 around the peripheral areas.

It will be evident from FIG. 2 that the greater width W of the top sheet compared with the width W' of the bottom sheet results in a communication of the air space between the sheets with the trough 13 and thus the plenum chamber 27. Thus once the bottom sheet has been preformed with channels as a consequence of the small holes 15, these holes are sealed off by the portions of the bottom sheet drawn into the channels and further channels are defined by the bottom sheet itself for facilitating the withdrawing of air from between the sheets.

It will be understood that when substantially all of the air is withdrawn from between the bottom and top sheets 21 and 25 as indicated by the arrows in FIG. 2, the engaging portions of the sheets will seal together.

The basic advance of the foregoing apparatus and method over the prior art resides in the provision of channels rather than protuberances on the platen surface 10.

Figure 3:
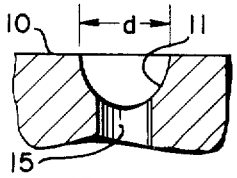
FIG. 3 is an enlarged fragmentary cross section taken in the direction of the arrows 3-3 of FIG. 1.
Figure 4:
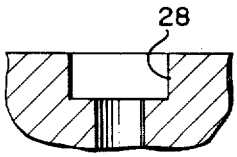
FIG. 4 is a view similar to FIG. 3 but illustrating a modified structure.
Figure 5:
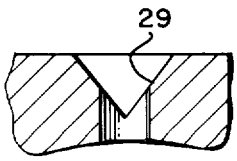
FIG. 5 is a view similar to FIG. 3 illustrating yet another modified structure.

FIG. 3 shows in fragmentary view the cross section of the channels 11 of FIG. 1 wherein it will be noted that they are essentially semi-circular in cross section. It should be appreciated, however, that these channels may be rectangular in cross section such as indicated at 28 in FIG. 4 or V-shaped in cross section such as indicated at 29 in FIG. 5.

Figure 6:
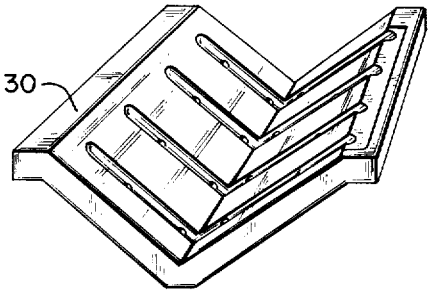
FIG. 6 is a perspective view of a modified platen structure which could be used with the system of FIG. 1.

In accord with further features of the present invention, it is not essential that the platen 10 be flat. In the case of semi-liquid type products or in the case of packaging fowl such as chicken or turkey with wings, it might be desirable to provide a V-shaped platen such as shown at 30 in FIG. 6, the V-sides preshaping the bottom sheet not only with channels but with a general V shape which will cradle the wings of the fowl.

Figure 7:
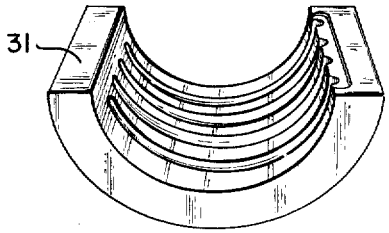
FIG. 7 is a view similar to FIG. 6 showing a further modified platen structure.

Other shapes such as a general concave curved shape may also be provided for the platen such as indicated for the shaped platen 31 of FIG. 7.

Figure 8:
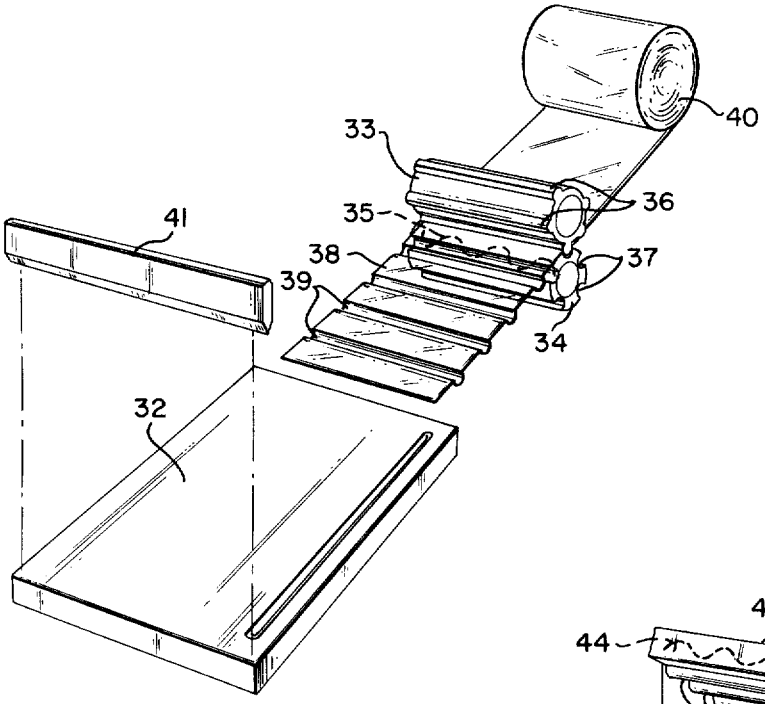
FIG. 8 is an exploded diagramatic type perspective view illustrating certain method steps in accord with the present invention.

Referring now to FIG. 8, there is shown a modified apparatus and illustration of a modified method for preforming the bottom sheet preparatory to a vacuum packaging operation. In FIG. 8, the platen is shown at 32 provided with a trough so that air may be withdrawn between bottom and top sheets all as described in FIG. 1. In this connection, however, the platen 32 does not contain the transverse channels but only the trough. A suitable housing for lowering an upper sheet onto the lower sheet would normally be provided in FIG. 8 but is not shown to avoid obscuring other portions of the drawing.

Thus, in the system of FIG. 8 rather than utilizing the platen 32 to effect a preforming of the bottom sheet with transverse channels, instead there is provided a pair of rollers 33 and 34. A heater schematically indicated by the dashed lines at 35 may be provided to heat the rollers to a temperature of, for example, from 163°F to 240°F.

As shown in FIG. 8, one of the rollers such as roller 33 includes peripheral ribs 36 extending parallel to the roller axis and circumferentially spaced.

The other roller 34 in turn includes mating peripheral grooves 37 extending parallel to the roller axis and circumferentially spaced to respectively receive the ribs.

With the foregoing arrangement, a bottom sheet of plastic film 38 may be passed between the rollers 33 and 34 and have formed therein transverse channels indicated at 39 prior to being received on top of the platen 32. In this respect, a supply reel 40 of the plastic sheet material may be positioned behind the rollers to automatically feed the material as needed through the rollers.

It will be understood that when a given length of the bottom plastic sheet film 38 has been received on top of the platen 32, a product such as described in FIG. 1 would be placed thereon and an upper housing such as shown in FIG. 1 together with a top sheet lowered thereover and the evacuation and sealing process takes place as described in conjunction with FIG. 2.

After the product has been sealed, the same would be moved off the front portion of the platen and a subsequent bottom sheet of plastic film positioned on the platen 32. A knife 41 may be brought down to sever the sealed product from the new bottom plastic sheet positioned on the platen 32 preparatory to a subsequent sealing operation.

Figure 9:
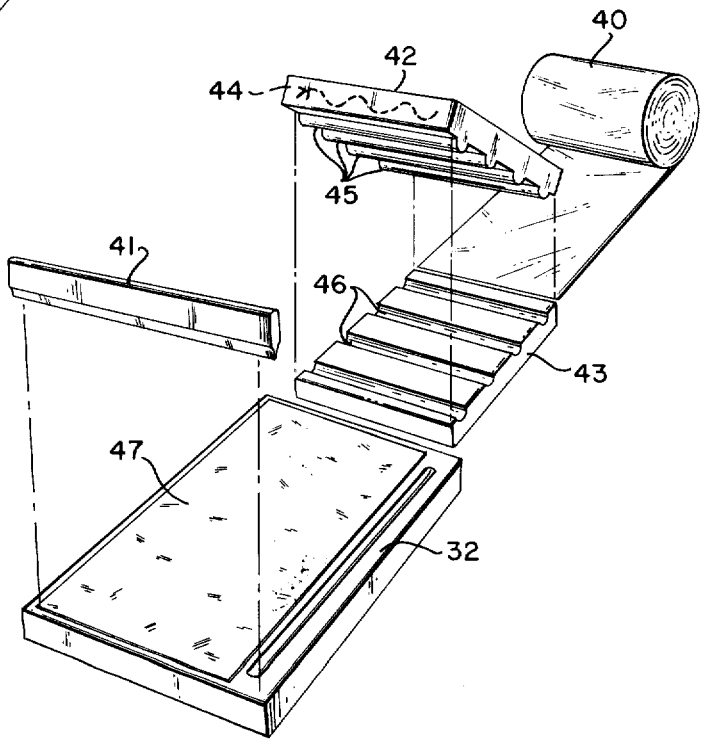
FIG. 9 is a view similar to FIG. 8 showing an alternative method step in accord with the invention.

FIG. 9 shows an alternative method of preforming the bottom plastic sheet wherein again there is shown the same platen 32 and severing knife 41. In the embodiment of FIG. 9, there are provided a pair of heated presses 42 and 43, the heater being schematically indicated at 44. One of these presses such as 42 includes transverse ribs 45 parallel to each other and spaced apart a distance greater than the width of the ribs. The other press 43 in turn includes mating parallel grooves 46 spaced to respectively receive the ribs so that the channels in the bottom of the plastic sheet 38 are pressed therein when the same is squeezed between the presses.

As in the case of FIG. 8, the bottom plastic sheet of film 38 may be supplied from a roll 40 intermittently to the presses to carry out the preforming operation prior to being utilized to seal the product on the platen 32.

In FIG. 9 there is shown a heat insulating sheet 47 which could be asbestos positioned between the platen and bottom sheet so that the bottom sheet will retain its heat.

In all of the embodiments except FIG. 8, the transverse channels preformed on the bottom sheet have a width less than the spacing or distance between the parallel transverse channels although such is not essential. The width of each of the channels may be from 0.05 to 0.25 the spacing between the channels. In the embodiment illustrated in FIG. 1, the width $d$ is 0.20 of the width D.

The heating means 24 in FIG. 1 and as utilized to heat the top sheet in the other embodiments may constitute means for circulating hot air over the sheet.

From the foregoing description, it will be evident that the present invention has provided an improved vacuum packaging system which lends itself well to automated processes and wherein by the unique platen design and basic concept of preforming with transverse channels as opposed to protuberances or other types of deformation, vastly improved results ensue.

What is claimed is:

1. A vacuum packaging apparatus including, in combination:

a. a platen having a plurality of transverse parallel channels formed in its top surface running from points spaced inwardly of one longitudinal edge across the platen to terminate in a longitudinal trough parallel and adjacent to the opposite longitudinal edge, said platen further including an interior plenum chamber and having holes in the floor of each of said channels communicating with said plenum chamber and a communication passage between said plenum chamber and trough;

b. vacuum drawing means connected with said plenum chamber;

c. a bottom sheet of plastic film positioned on the top surface of said platen and having a given width such that a longitudinal edge of the bottom sheet does not extend over said trough;

d. a movable housing having an open bottom positioned to be brought down on top of said platen and including heating means; and e. a top sheet of plastic film received under said housing above the bottom sheet and of a width greater than the width of the bottom sheet so as to overlie said trough, whereby a vacuum may be drawn in said plenum chamber to preform channels in said bottom sheet by exterior air pressure urging the portions of the sheet overlying said channels into said channels, at least one product to be sealed being placed on said bottom sheet and said movable housing heating said top sheet and bringing it down over the product, the air between the sheets being drawn out through said channels preformed in the bottom sheet and said trough until the bottom and top sheet portions brought into contact seal together after substantially complete evacuation of the air therebetween.

2. An apparatus according to claim 1, in which each of said channels in said platen is semi-circular shaped in cross section.

3. An apparatus according to claim 1, in which each of said channels in said platen is rectangularly shaped in cross section.

4. An apparatus according to claim 1, in which each of said channels in said platen is V-shaped in cross section.

5. An apparatus according to claim 1, in which the top surface of said platen defines a V-shape.

6. An apparatus according to claim 1, in which the top surface of said platen is concave.

7. An apparatus according to claim 1, in which said vacuum drawing means includes a fixed volume tank of air; valve means connecting said tank to said plenum chamber; and vacuum pump means connected to said tank whereby said tank may initially be evacuated and thence placed in communication with said plenum chamber by opening said valve means to thereby draw said vacuum.

8. An apparatus according to claim 1, in which the width of each of said channels is from 0.05 to 0.25 the spacing between said channels.

9. An apparatus according to claim 1, in which said heating means includes means for circulating hot air over the top sheet.

10. A vacuum packaging apparatus including, in combination:

a. a platen having a longitudinal trough parallel and adjacent to a longitudinal edge and including an interior plenum chamber communicating with said trough;

b. vacuum drawing means connected with said plenum chamber;

c. a bottom sheet of plastic film;

d. means for forming a plurality of transverse channels in said bottom sheet said bottom sheet being positioned on the top surface of said platen and having a given width such that a longitudinal edge of the bottom sheet does not extend over said trough;

e. a movable housing having an open bottom positioned to be brought down on top of said platen and including heating means; and f. a top sheet of plastic film received under said housing above the bottom sheet and of a width greater than the width of the bottom sheet so as to overlie said trough, whereby a vacuum may be drawn in said plenum chamber, at least one product to be sealed being placed on said bottom sheet and said movable housing heating said top sheet and bringing it down over the product, the air between the sheets being drawn out through said channels preformed in th4 bottom sheet until the bottom and top sheet portions brought into contact seal together after substantially complete evacuation of the air therebetween.

11. An apparatus according to claim 10, including a sheet of heat insulating material between the bottom sheet and said platen.

12. An apparatus according to claim 10, in which said heating means includes means for circulating hot air over said top sheet.

* * * * *